US006240928B1

(12) United States Patent
DaSilva

(10) Patent No.: US 6,240,928 B1
(45) Date of Patent: Jun. 5, 2001

(54) HAIR COLORING TOOL

(76) Inventor: Denivaldo G. DaSilva, 200 W. 78th St., Apt. 2-D, New York, NY (US) 10024

( * ) Notice: Subject to any disclaimer, the term of this patent is extended or adjusted under 35 U.S.C. 154(b) by 0 days.

(21) Appl. No.: 09/524,143

(22) Filed: Mar. 10, 2000

(51) Int. Cl.[7] ..... A45D 24/16; A45D 24/38; A45D 24/00

(52) U.S. Cl. ..... 132/120; 132/145; 132/219

(58) Field of Search ..... 132/120, 219, 132/129, 132, 148, 150, 145, 208

(56) References Cited

U.S. PATENT DOCUMENTS

| | | | | |
|---|---|---|---|---|
| D. 137,637 | | 4/1944 | Nelson et al. . | |
| D. 159,106 | | 6/1950 | Stamp . | |
| D. 183,167 | | 7/1958 | Gore . | |
| D. 268,225 | | 3/1983 | Ellenson . | |
| D. 405,614 | | 2/1999 | Geardino et al. . | |
| 1,546,037 | | 7/1925 | Smart . | |
| 2,004,044 | * | 6/1935 | Fiegel | 132/120 |
| 2,162,581 | | 6/1939 | Kapelman . | |
| 2,181,448 | * | 11/1939 | Behr | 132/120 |
| 2,207,427 | * | 9/1940 | Behr | 132/100 |
| 2,261,755 | * | 11/1941 | Downs et al. | 132/120 |
| 2,602,457 | | 7/1952 | Mele . | |
| 3,147,757 | | 9/1964 | Hofmann . | |
| 5,007,442 | * | 4/1991 | Hirzel | 132/218 |
| 5,058,609 | | 10/1991 | Sandoz et al. . | |
| 5,146,937 | | 9/1992 | Lefebvre . | |
| 5,337,765 | | 8/1994 | Wong . | |
| 5,533,537 | | 7/1996 | Mourad . | |
| 6,029,307 | * | 2/2000 | Baudoin | 15/145 |
| 6,062,231 | * | 5/2000 | De Laforcade | 132/145 |

FOREIGN PATENT DOCUMENTS

| | | |
|---|---|---|
| 359644 | 11/1931 | (GB) . |

* cited by examiner

*Primary Examiner*—Ralph A. Lewis
*Assistant Examiner*—Robyn Kieu Doan
(74) *Attorney, Agent, or Firm*—Coudert Brothers

(57) ABSTRACT

A hair coloring tool combining a styling comb and a hair coloring brush into a single easy to use device is disclosed. The hair coloring brush is secured to the styling comb by an assembly which is capable of holding the hair coloring brush at various angular positions relative to the comb to promote easy application of hair coloring agents to selected strands of hair.

16 Claims, 1 Drawing Sheet

HAIR COLORING TOOL

FIELD OF THE INVENTION

The present invention generally relates to hair coloring tools and, more particularly, to a hair coloring tool which combines a hair separating element and a color applicator in a single tool.

BACKGROUND OF THE INVENTION

In recent years it has become increasingly popular to treat hair. More specifically, it has become popular to add highlights or coloring to one's hair. Traditionally, highlighting and hair coloring has been performed in beauty salons by professional stylists. When highlighting hair, the first step is to separate the hair that is to be colored from the remaining strands of hair. This is normally performed by the stylist using a comb, or other suitable device, to separate the hair. Next, coloring the hair a particular color is performed. This is normally performed by using a separate brush or other suitable color applicator to apply a coloring agent to the selected strands of hair.

Separating and coloring of the hair requires a stylist to alternate between using the comb, then the brush. This can become cumbersome and inconvenient for the stylist as the stylist must repeatedly pick-up and set down the comb and brush. Furthermore, the constant switching of the comb and brush necessarily lengthens the total time spent on the highlighting process. Moreover, the constant switching of the comb and brush makes highlighting one's own hair, without the use of a stylist, extremely difficult.

SUMMARY OF THE INVENTION

The aforementioned and related drawbacks associated with conventional hair coloring tools are substantially reduced or eliminated by the hair coloring tool of the present invention which provides a combination hair detangling and separator element and hair color application element in a single tool. In an exemplary embodiment of the present invention, the coloring tool comprises an elongated element having a first end portion, a second end portion and a handle portion intermediate the first and second end portions, the handle portion having an opening formed therethrough; a hair color applicator having a proximal end portion and a distal end portion, the proximal end portion having an opening formed therethrough; and a connection assembly, coupled along the length of the handle portion of the elongated element and adapted to rotatibly position the hair color applicator at operating angles relative to the elongated element.

An advantage of the present invention is that it incorporates a plurality of hair styling tools into a single device.

Another advantage of the present invention is that it prevents unnecessary mess during hair coloring.

Yet another advantage of the present invention is that it is easy to use.

A feature of the present invention is that it is easy to manufacture.

BRIEF DESCRIPTION OF THE DRAWINGS

The aforementioned and related advantages and features of the present invention will become apparent upon review of the following detailed description of the invention, taken in conjunction with the following drawings, where like numerals represent like elements, in which.

DETAILED DESCRIPTION OF THE INVENTION

Figures 1, 2:
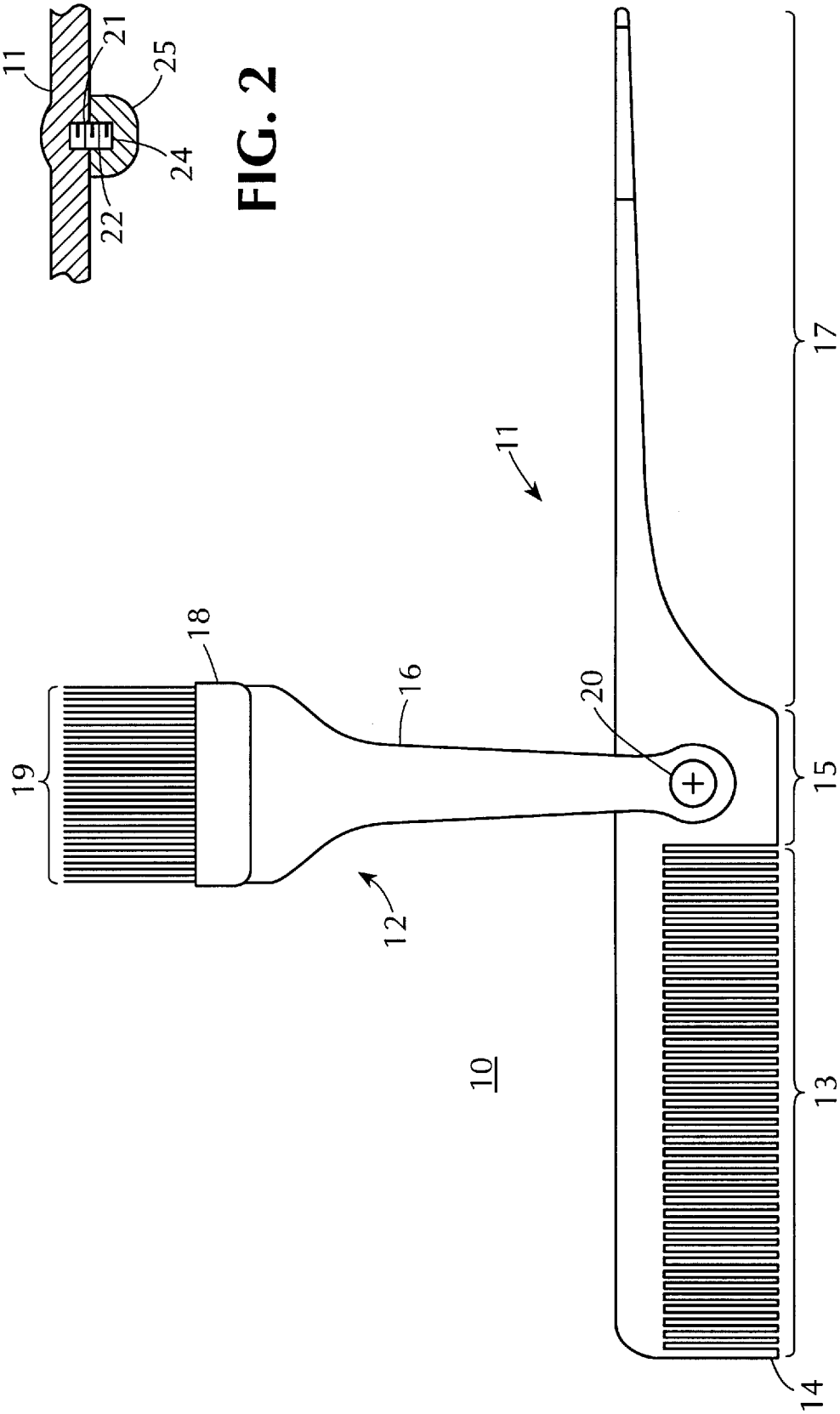
FIG. 1 is a side view of the hair coloring tool of the present invention.
FIG. 2 is a cross-sectional top view of the rotational connection assembly of the present invention.

The hair coloring tool of the present invention will now be described with reference to 2 FIGS. 1 and 2. FIG. 1 is a side view of the hair coloring tool of the present invention. As shown, the hair coloring tool 10 includes a hair separating element 11, a hair color applicator element 12, and a connection assembly 20. In a preferred embodiment, the hair separating element 11 comprises a comb having a first end portion 13, including a plurality of teeth 14 downwardly extending therefrom. The teeth 14 are used to detangle the hair that is to be colored. The comb has a central handle portion 15 having a threaded opening 21 formed therethrough. The comb also includes an elongated pick portion 17 which extends in a tapered manner from the end of the handle portion 15, opposite the comb 13, and provides a mean for the user to separate and weave the hair to be colored. In a preferred embodiment, the comb 11 has a total length of about 10 inches and is composed of a molded, flexible chemical resistant material such as plastic. Other chemical resistant materials can be used instead of plastic.

The hair color applicator element 12 includes a handle 16 having a threaded opening 22 formed at one end thereof. A brush 19, suitable for applying a coloring agent to the hair strands, is coupled to the opposite end of the handle 16 by an attachment piece 18. In a preferred embodiment, the brush 12 is composed of a chemical resistant material such as plastic. However, other chemical resistant materials can be used.

The hair color applicator element 12 is rotatibly engaged to the comb 11 by a connection assembly 20. As shown in greater detail in FIG. 2, the connection assembly 20 is comprised of a screw 24 which is in threaded communication with the openings 21, 22 of the comb 11 and the hair color applicator element 12, respectively. By engaging the comb 11 and the hair color applicator element 12 in such a fashion, the hair color applicator 12 can be positioned at operating angles (i.e. 30°, 60°, 90°, etc.) relative to the comb 11. As such, the hair color applicator 12 can be placed flush against the comb 11 when not in use or at operating positions relative to the comb 11 when a coloring agent is being applied to selected strands of hair. A cover 25 can be placed over the head of the screw 24 to protect it from damage.

The method of using the hair coloring tool 10 of the present invention will now be described. First, handle 12 is rotated away from the comb 11 and a suitable coloring agent is applied to the brush 19. Next, the user detangles and separates the strands of hair to be colored using the teeth 14 and places the selected strands of hair on a coloring foil or other suitable device. The strands of hair are then sectioned and woven with the pick 17 to enable highlighting and streaking. Then, the coloring agent is applied to the hair by passing the brush 19 over the hair as needed. To complete the process, the colored hair is wrapped in the coloring foil for a predetermined period. Upon expiration of the predetermined period, the coloring agent has been absorbed by and reacted with the hair, thereby changing its color. Thus, by using the coloring tool of the present invention, the user can detangle, separate and apply coloring agent to selected strands of hair without having to repeatedly pick up and set down multiple styling tools.

The foregoing detailed description of the invention has been provided for the purposes of illustration and description. Although an exemplary embodiment of the present invention has been described in detail herein with reference to the accompanying drawings, it is to be understood that the invention is not limited to the precise embodiment disclosed, and that various changes and modifications to the invention are possible in light of the above teaching. Accordingly, the scope of the present invention is to be defined by the claims appended hereto.

What is claimed is:

1. A coloring tool, comprising:

an elongated comb having a first end portion, a second end portion, and a central portion intermediate between said first and second end portions, said central portion having an opening formed therethrough wherein said first end portion comprises a comb portion having a plurality of teeth extending therefrom and said second end portion comprises a handle;

a hair color applicator brush having a proximal end and a distal end, said proximal end having an opening formed therethrough, wherein said proximal end of said hair color applicator brush comprises a handle and said distal end portion comprises a brush portion having a plurality of bristles; and a connection assembly connecting said elongated comb and hair color applicator brush, wherein said connection assembly is coupled through said opening of said central portion of said elongated comb and said opening of said hair color applicator brush and wherein said connection assembly is adapted to rotatibly position said hair color applicator brush in at least two distinct operating positions relative to said elongated comb.

2. The coloring tool of claim 1, wherein said connection assembly further comprises a fastener fixedly engaged through said central portion opening and the opening in said proximal end of said hair color applicator brush.

3. The coloring tool of claim 2, wherein said fastener comprises a screw having a plurality of threads operative to maintain said hair color applicator brush at angular positions relative to said elongated element.

4. The coloring tool of claim 1, wherein the handle of said elongated comb further comprises a pick extending in a tapered manner from an end of said central portion opposite said comb.

5. The coloring tool of claim 1, wherein said hair color applicator brush is removably secured by said connection assembly.

6. A hair coloring tool for use in highlighting hair, comprising:

a comb comprising a handle, a comb portion and a central portion intermediate between said handle and comb portion, said central portion having an opening formed therethrough;

a coloring brush comprising a handle portion having a proximal end and distal end, said coloring brush having an opening formed through said proximal end of said handle portion, said coloring brush further comprising a brush portion extending from said distal end of said handle portion of said coloring brush, said brush portion having a plurality of bristles; and a connection assembly coupled through said opening of said central portion of said comb and said opening of said coloring brush and adapted to rotatibly position said coloring brush relative to said comb.

7. An hair coloring tool for use in hair coloring procedures, the hair coloring tool comprising;

a comb, the comb further comprising:

a handle portion, wherein the handle portion has distal end and a proximal end, the handle tapering to a greater dimension towards the proximal end;

a intermediate portion extending from the proximal end of the handle portion, wherein the intermediate portion is of suitable dimension so that it may be grasped during hair coloring procedures, the intermediate portion having an opening for accepting a fastener;

a comb portion extending from the intermediate portion in a direction opposite to the handle portion, the comb portion comprising a longitudinally-extending top portion, and a plurality of teeth extending downwardly from the top portion;

a hair color applicator brush, the hair color applicator brush further comprising:

a handle portion, the handle portion having a proximal end and a distal end, the proximal end having an opening for overlapping the opening of the intermediate portion;

a bristle holder extending from the distal end of the handle, the bristle holder comprising a member having a plurality of holes for holding bristles extending from the member;

a plurality of bristles mounted in the holes of the bristle holder; and a fastener connecting the comb and brush through the opening in the intermediate portion of the comb and the proximal end of the handle of the hair color applicator brush, the fastener permitting rotational movement of hair color applicator brush about the opening in the intermediate portion of the comb.

8. The hair coloring tool of claim 7 wherein the fastener connecting the comb and the hair color applicator brush further comprises:

a detent mechanism for permitting the hair color applicator brush to be retained in at least two different angular positions with respect to the comb.

9. The hair coloring tool of claim 7 wherein the bristles of the hair color applicator brush extend in a direction substantially radially away from the opening in the intermediate portion of the comb.

10. The hair coloring tool of claim 8 wherein the bristles of the hair color applicator brush extend in a direction substantially radially away from the opening in the intermediate portion of the comb.

11. The coloring tool of claim 1 wherein said bristles of said hair color applicator brush extend in a direction substantially radially away from said opening in said central portion of said elongated comb in both of the at least two distinct operating positions of said hair color applicator brush.

12. The coloring tool of claim 1 wherein said central portion of said elongated comb is of suitable dimension so that it may be grasped during hair coloring procedures.

13. The coloring tool of claim 3 wherein said central portion of said elongated comb is of suitable dimension so that it maybe grasped during hair coloring procedures.

14. The hair coloring tool of claim 6 wherein the bristles of the coloring brush continue extending in a direction substantially radially away from the opening in the central portion of the comb as the coloring brush rotates about the opening in the central portion of the comb.

15. The hair coloring tool of claim 14 wherein said central portion of said comb is of suitable dimension so that it may be grasped during hair coloring procedures.

16. The hair coloring tool of claim 15 where in said connection assembly connecting said comb and said coloring brush further comprises:

a detent mechanism for permitting said coloring brush to be retained in at least two different angular positions with respect to the comb.

* * * * *